United States Patent [19]

Aono

[11] Patent Number: 4,501,240

[45] Date of Patent: Feb. 26, 1985

[54] IDLING SPEED CONTROL SYSTEM FOR INTERNAL COMBUSTION ENGINE

[75] Inventor: Shigeo Aono, Sekimachi, Japan

[73] Assignee: Nissan Motor Company, Limited, Japan

[21] Appl. No.: 469,513

[22] Filed: Feb. 24, 1983

[30] Foreign Application Priority Data

May 11, 1982 [JP] Japan ..... 57-77535

[51] Int. Cl.[3] ..... F02M 23/06

[52] U.S. Cl. ..... 123/339; 123/352; 123/589

[58] Field of Search ..... 123/339, 589, 340, 352

[56] References Cited

U.S. PATENT DOCUMENTS 4,289,100 9/1981 Kinugawa et al. ..... 123/339
4,306,527 12/1981 Kinugawa et al. ..... 123/339
4,398,514 8/1983 Nakamura ..... 123/339

FOREIGN PATENT DOCUMENTS 55-156234 4/1980 Japan .
56-72241 6/1981 Japan ..... 123/339

*Primary Examiner*—Andrew M. Dolinar
*Attorney, Agent, or Firm*—Lowe, King, Price & Becker

[57] ABSTRACT

An engine idling speed control system for an internal combustion engine which controls engine idling speed by adjusting the amount of intake air by-passing the throttle valve on the basis of the air-to-fuel ratio, in addition to the difference between the actual idling speed and the optimum idling speed determined on the basis of engine coolant temperature. The system according to the present invention comprises an air-to-fuel ratio determination section and an intake air calculation section for calculating the basic amount of intake air on the basis of the difference between the idling speed and the optimum idling speed and correcting the calculated basic amount of intake air on the basis of the air-to-fuel ratio.

13 Claims, 7 Drawing Figures

16
17
SPEED CALCULATING SECTION
18
OPTIMUM SPEED CALCULATING SECTION
19
(N0 - N)
21
INTAKE AIR CALCULATING SECTION
20
A/F RATIO DETERMINATION SECTION
N
N0
SD
H or L
INTAKE AIR AMOUNT CONTROL SIG Sac
SPEED SIG Ss
TEMP SIG ST
(STARTER SIG)
(AIR CON SIG)
A/F RATIO SIG Sr
30
STARTER SWITCH
31
AIR CON SWITCH

IDLING SPEED CONTROL SYSTEM FOR INTERNAL COMBUSTION ENGINE

BACKGROUND OF THE INVENTION

1. Field of the Invention

The present invention relates generally to an engine-speed control system for an internal combustion engine and more specifically to an engine idling speed control system whereby the amount of intake air by-passing a throttle valve is adjusted on the basis of the difference between actual idling speed and optimum idling speed.

2. Description of the Prior Art

There is well-known an engine idling speed control system for an internal combustion engine by which the amount of intake air by-passing a throttle valve is feed-back-controlled in response to a signal indicative of the difference between actual engine idling speed and optimum engine idling speed. In such a prior-art engine idling speed control system for an internal combustion engine, since the amount of intake air by-passing the throttle valve is adjusted on the basis of only the difference between actual speed and optimum speed, irrespective of the air-to-fuel ratio of the mixture, the engine idling speed controlled by the system fluctuates according to the air-to-fuel ratio. In greater detail, in the case where the mixture is rich, if the amount of intake air is increased by a predetermined guantity, engine idling speed will be increased excessively; on the other hand, in the case where the mixture is lean, even if the same amount of intake air is increased by the same quantity, engine idling speed will be increased only a little and in some cases may decrease instead. Similarly, in the case where the mixture is rich, if the amount of intake air is decreased by a certain quantity, engine idling speed will be decreased excessively; on the other hand; in the case where the mixture is lean, even if the amount of intake air is decreased by the same quantity, engine idling speed will be decreased only a little.

That is to say, in the prior-art engine idling speed control system for an internal combustion engine, since the engine idling speed is controlled irrespective of the air-to-fuel ratio and therefore the difference between actual engine idling speed and optimum engine idling speed is relatively great, there exists a problem in that engine idling speed varies momentarily and results in engine speed hunting; that is, the control stability of engine idling speed is not satisfactory.

SUMMARY OF THE INVENTION

With these problems in mind, therefore, it is the primary object of the present invention to provide an engine idling speed control system for an internal combustion engine which is superior in response time in transient state and in stability in steady state.

To achieve the above-mentioned object, the engine idling speed control system for an internal combustion engine according to the present invention is so improved as to adjust the amount of intake air by-passing the throttle valve on the basis of the difference between the actual engine idling speed and the optimum engine idling speed determined according to engine coolant temperature and additionally on the basis of the air-to-fuel ratio of the mixture.

The engine idling speed control system for an internal combustion engine according to the present invention comprises an engine speed sensor, an engine temperature sensor, an oxygen sensor, an actual engine speed calculating section, an optimum engine speed calculating section, a comparator for determining the difference between the actual engine idling speed and the optimum engine idling speed, an air-fuel ratio determining section, an intake air amount calculating section for calculating the basic amount of intake air on the basis of the speed difference and for correcting the basic amount on the basis of the air-to-fuel ratio, and an air flow adjuster.

Further, in the case where a microcomputer is incorporated within the system, the same or similar functions of the actual engine speed calculating section, the optimum engine speed calculating section, the comparator, the air-to-fuel ratio determining section, and the intake air amount calculating section are all implemented via arithmetic operations executed in accordance with appropriate software, in place of hardware.

BRIEF DESCRIPTION OF THE DRAWINGS

The features and advantages of the engine idling speed control system for an internal combustion engine according to the present invention will be more clearly appreciated from the following description taken in conjunction with the accompanying drawings in which like reference numerals or labels designate the same elements or sections or meanings throughout the drawings and in which.

DETAILED DESCRIPTION OF THE PREFERRED EMBODIMENTS

Figure 1:
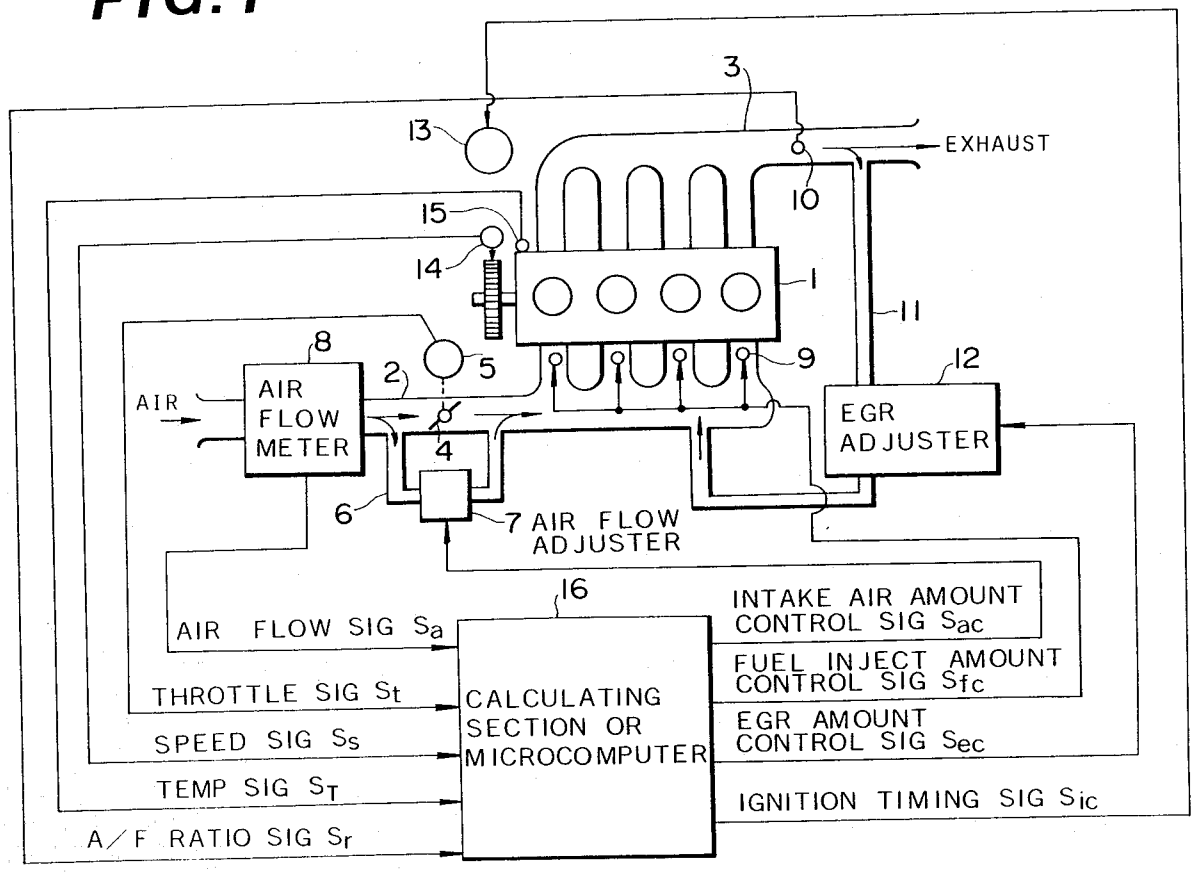
FIG. 1 is a diagrammatic illustration of a typical four-cylinder internal combustion engine and a schematic block diagram of an embodiment of the engine idling speed control system for an internal combustion engine according to the present invention.

FIG. 1 shows an embodiment of the engine idling speed control system for an internal combustion engine according to the present invention. In the figure, the reference numeral 1 denotes a four-cylinder internal combustion engine provided with an intake pipe 2 and an exhaust manifold 3.

The reference numeral 4 denotes a throttle valve and the reference numeral 5 denotes a throttle valve position sensor mechanically connected to the throttle valve 4 for outputting a throttle valve position signal $S_t$ indicative of the throttle valve opening rate. The reference numeral 6 denotes a by-pass pipe communicating across the upstream and downstream sides of the throttle valve 4 disposed within the intake pipe 2, and the reference numeral 7 denotes an air flow adjuster disposed in the by-pass pipe 6. Being made up of a single electromagnetic valve or the combination of an electromagnetic valve and a vacuum valve, this air flow adjuster 7 can adjust the amount of intake air supplied into the engine cylinders through the by-pass pipe 6 in response to an intake air amount control signal $S_{ac}$.

The reference numeral 8 denotes an intake air amount sensor (e.g. an air-flow meter) for outputting an air-flow signal $S_a$ indicative of the amount of air supplied into the engine cylinders.

The reference numeral 9 denotes a plurality of fuel injection valves disposed in each of intake ports of the engine cylinders, respectively, for injecting the amount of fuel in response to a fuel injection amount control signal $S_{fc}$.

The reference numeral 10 denotes an oxygen sensor (e.g. a zirconia oxygen sensor) disposed in the exhaust manifold 3 for outputting an air-to-fuel ratio signal $S_r$ indicative that the fuel mixture is rich or lean.

The oxygen sensor is provided with a characteristic such that the voltage developed thereacross changes abruptly when a ratio of oxygen concentration in the atmosphere to that in the exhaust gas, that is, the air-fuel ratio exceeds or drops below a certain critical value; in more detail, the oxygen sensor generates a high-voltage (about one volt) level signal when the mixture is enriched dropping below a certain critical air-fuel ratio and a low-voltage (almost zero volts) level signal when the mixture is leaned exceeding the critical air-fuel ratio. Therefore, when an oxygen concentration ratio obtained when the mixture is combusted at an optimum air-fuel ratio is so set as to coincide with this critical value, it is possible to detect the air-fuel ratio by utilizing the H- or L-voltage level oxygen sensor signal. That is to say, in the case when the mixture is rich, the oxygen sensor outputs a high-voltage level signal; in the case where the mixture is lean, the oxygen sensor outputs a low-voltage level signal.

The reference numeral 11 denotes an exhaust gas recirculation pipe communicating across the intake pipe 2 and the exhaust manifold 3 and the reference numeral 12 denotes a recirculation gas flow adjuster disposed in the exhaust gas recirculation pipe 11. This recirculation gas flow adjuster 12 can adjust the amount of the exhaust gas recirculated from the exhaust manifold side to the intake pipe side through the exhaust gas recirculation pipe 11 in response to an exhaust gas recirculation (EGR) amount control signal $S_{ec}$. The structure of this adjuster 12 is almost the same as that of the air flow adjuster 7.

The reference numeral 13 denotes an ignition device for applying a high ignition voltage signal to each ignition plug (not shown) disposed for each engine cylinder in response to an ignition timing signal $S_{ic}$.

The reference numeral 14 denotes an engine speed sensor (e.g. a crankshaft angle position sensor to output a signal whenever the crankshaft rotates through a predetermined angle) for outputting an engine speed signal $S_s$.

The reference numeral 15 denotes an engine temperature sensor for outputting an engine temperature signal $S_T$ indicative of engine coolant temperature.

The reference numeral 16 denotes a calculating section or a microcomputer, to which various sensor signals such as the air flow signal $S_a$ indicative of the amount of intake air, the throttle valve signal $S_t$ indicative of throttle valve position or opening rate, the engine speed signal $S_s$, the engine temperature signal $S_T$ and the air-to-fuel ratio signal $S_r$ indicative of rich fuel or lean fuel are inputted. The calculating section 16 calculates various optimum engine operating conditions such as the amount of fuel to be injected, the amount of exhaust gas to be recirculated, the timing of fuel injection and outputs various control signals such as a fuel injection amount control signal $S_{fc}$ corresponding to the calculated amount of fuel to be injected, an exhaust gas recirculation control signal $S_{ec}$ corresponding to the calculated amount of exhaust gas to be recirculated, and an ignition timing signal $S_{ic}$ corresponding to the optimum fuel ignition timing.

The above-mentioned functions are well known as an electronic engine control system. In addition to the above-mentioned functions, the calculating section 16 further functions to control the engine idling speed. That is to say, the calculating section 16 determines whether or not the engine is being idled on the basis of the throttle valve signal $S_t$ (the throttle valve is fully closed during engine idling) and outputs an intake air flow amount control signal $S_{ac}$ for adjusting the amount of intake air by-passing the throttle valve in response to the engine speed signal $S_s$, engine temperature signal $S_T$, and air-to-fuel ratio signal $S_r$.

A more detailed description will be made hereinbelow of the functions of controlling engine idling speed.

Figure 2:
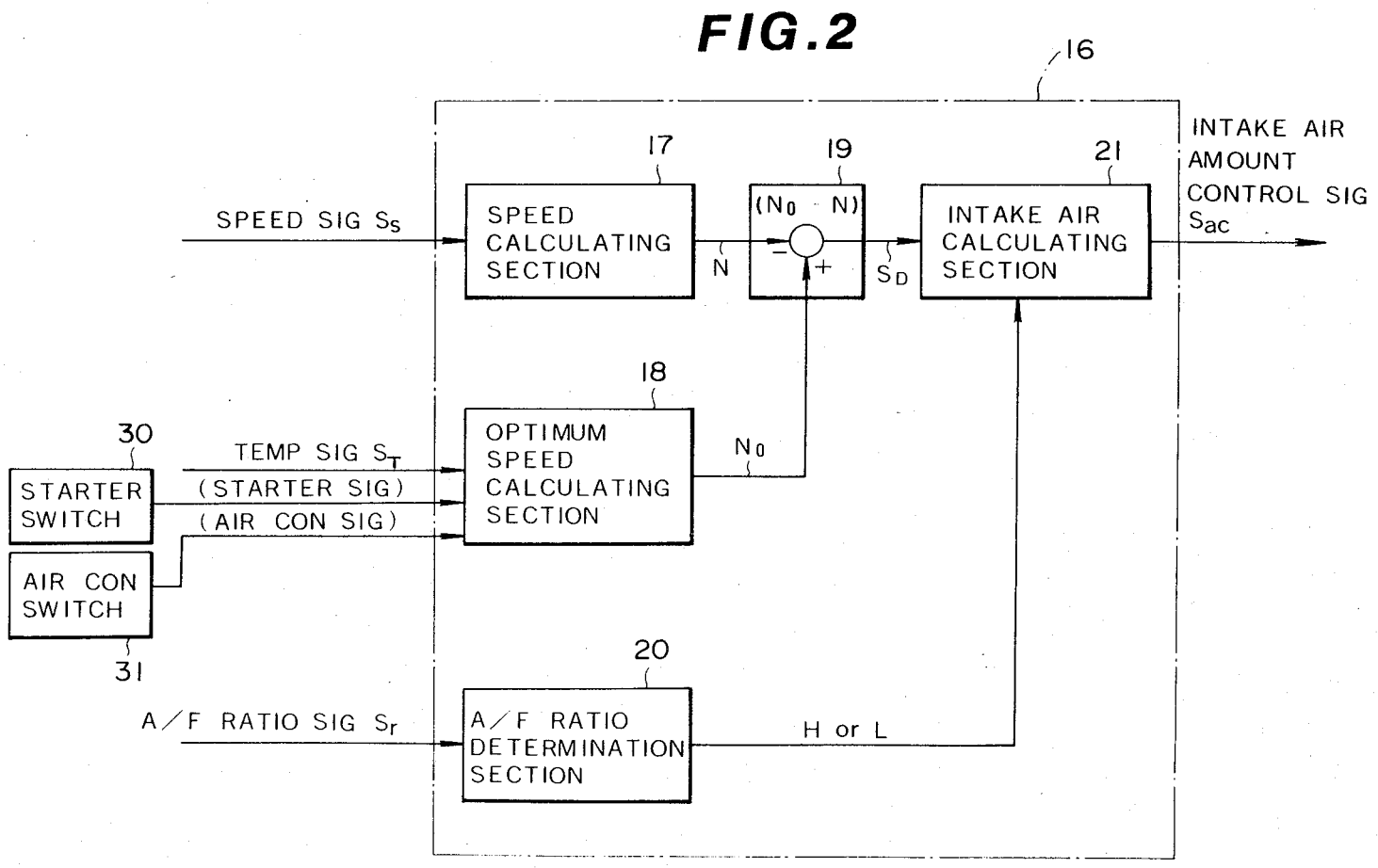
FIG. 2 is a schematic block diagram of the essential portion of the calculating section of the idling speed control system for an internal combustion engine according to the present invention shown in FIG. 1.

FIG. 2 shows only the essential portion of the calculating section 16 related to the engine idling speed control system according to the present invention.

In the figure, the reference numeral 17 denotes an engine speed calculating section for calculating an actual engine speed in response to the engine speed signal $S_s$ inputted from the engine speed sensor 14 and outputting an actual engine speed signal N. The reference numeral 18 denotes an optimum engine speed calculating section for calculating an optimum engine idling speed in response to the temperature signal $S_T$ or other signals indicative of other engine operating conditions such as a starter signal indicative of turning-on of an engine starter switch 30, and an air conditioner signal indicative of turning-on of an air conditioner switch 31 and outputting an optimum engine idling speed signal $N_o$. This optimum engine idling speed is approximately 600 rpm in an ordinarily state, but is set to a value higher than 600 rpm in the case where the engine coolant temperature is low, the engine is being started or other equipment (e.g. air conditioner) is in operation.

The reference numeral 19 denotes a comparator for comparing the calculated actual engine idling speed N with the calculated optimum engine idling speed $N_o$ and outputting a speed difference signal $S_D$ indicative of $(N_o - N)$.

The reference numeral 20 denotes an air-to-fuel ratio determination section for determining whether the fuel is rich or lean in response to the air-to-fuel ratio signal $S_r$ inputted from the oxygen sensor 10 and outputting another logically high-voltage level signal (H) in the case where the fuel is rich and another logically low-voltage level signal (L) in the case where the fuel is lean.

The reference numeral 21 denotes an intake air amount calculating section for calculating basic amount of intake air by-passing the throttle valve and correcting the basic amount of intake air taking into consideration the H- or L-voltage level signal from the air-to-fuel ratio determination section 20.

In greater detail, in the case the difference signal $S_D$ is possitive; that is, the calculated actual engine idling speed N is below the calculated optimum engine idling speed $N_o$, the intake air amount calculating section 21 outputs an intake air amount control signal $S_{ac}$ to increase the amount of intake air by-passing the throttle valve; in the case where the difference signal $S_D$ is negative; that is, the calculated actual engine idling speed N is above the calculated optimum engine idling speed $N_o$, the intake air amount calculating section 21 outputs an intake air amount control signal $S_{ac}$ to decrease the amount of intake air by-passing the throttle valve.

In this case, the basic amount of intake air by-passing the throttle valve is obtained in proportion to the difference between the optimum engine idling speed $N_o$ and the actual engine idling speed N, or to the integrated value of the difference between $N_o$ and N, or to the addition of the difference between the two and the integrated value of the difference between the two.

Additionally, in the case where the air-to-fuel ratio determination section 20 outputs a H-voltage level signal; that is, the fuel is rich, the basic amount of intake air is corrected to a reduced value by multiplying the calculated basic amount by a predetermined positive multiplier less than one or by subtracting a predetermined negative addend to the calculated basic amount.

On the other hand, in the case where the air-to-fuel ratio determination section 20 outputs a L-voltage level signal; that is, the fuel is lean, the basic amount of intake air is corrected to a greater value by multiplying the calculated basic amount by a predetermined positive multiplier greater than one or by adding a predetermined positive addend to the calculated basic amount.

The operation of the engine idling speed control system according to the present invention will be described hereinbelow.

When the engine is being idled, the throttle valve position sensor 5 detects this state because the throttle valve 4 is fully closed and outputs a throttle valve position signal $S_t$ indicative of engine idling. In response to this throttle valve position signal $S_t$, the calculating section 16 calculates the optimum amount of intake air to be by-passed and outputs an optimum intake air amount control signal $S_{ac}$ to the air flow adjuster 7.

In more detail, the speed calculating section 17 calculates the actual engine idling speed N in response to an engine speed signal $S_s$ detected by the engine speed sensor 14 such as a crankshaft angle position sensor and outputs a signal N indicative of the actual engine idling speed.

The optimum speed calculating section 18 calculates the optimum engine idling speed $N_o$ in response to the present engine coolant temperature signal $S_T$ detected by the engine temperature sensor 15, the engine starter signal detected by the engine starter switch 30 and the air-conditioner signal detected by the air-conditioner switch 31 and outputs a signal $N_o$ indicative of the optimum engine idling speed.

The comparator 19 compares the signal N with the signal $N_o$ and outputs the engine speed difference signal $S_D$.

On the other hand, the air-to-fuel ratio determination section 20 determines whether the present fuel mixture supplied into the engine cylinders is rich or lean in response to the air-to-fuel ratio signal $S_r$ detected by the oxygen sensor 10 and outputs and stores a H-voltage level signal when the fuel is rich and a L-voltage level signal when the fuel is lean.

The intake air amount calculating section 21 calculates the basic amount of intake air to be supplied into the air cylinders by-passing the throttle valve in response to the present engine speed difference signal $S_D$, corrects the basic amount of intake air in response to the H- or L-voltage level signal, and outputs the intake air amount control signal $S_{ac}$ to the air flow adjuster 7.

In greater detail, when the actual engine idling speed N is below the calculated optimum engine idling speed $N_o$, the intake air amount calculating section 21 outputs an intake air amount control signal to increase the amount of intake air; when the actual engine idling speed N is above the calculated optimum engine idling speed $N_o$, the intake air amount calculating section 21 outputs an intake air amount control signal to decrease the amount of intake air. Additionally, when the fuel is rich, the determined basic amount of intake air is decreased in accordance with a predetermined smaller multiplier or addend; when the fuel is lean, the determined basic amount of intake air is increased in accordance with a predetermined greater multiplier or addend. That is to say, the amount of intake air supplied into the engine cylinders by-passing the throttle valve is controlled on the basis of two factors of engine idling speed and air-to-fuel ratio, with the result that it is possible to improve a faster response time in transient state and a better stability in steady state.

FIGS. 3(A), 3(B), 3(C) and 3(D) show the waveforms of various signals and the timing chart thereof.

Figures 3A, 3B, 3C, 3D:
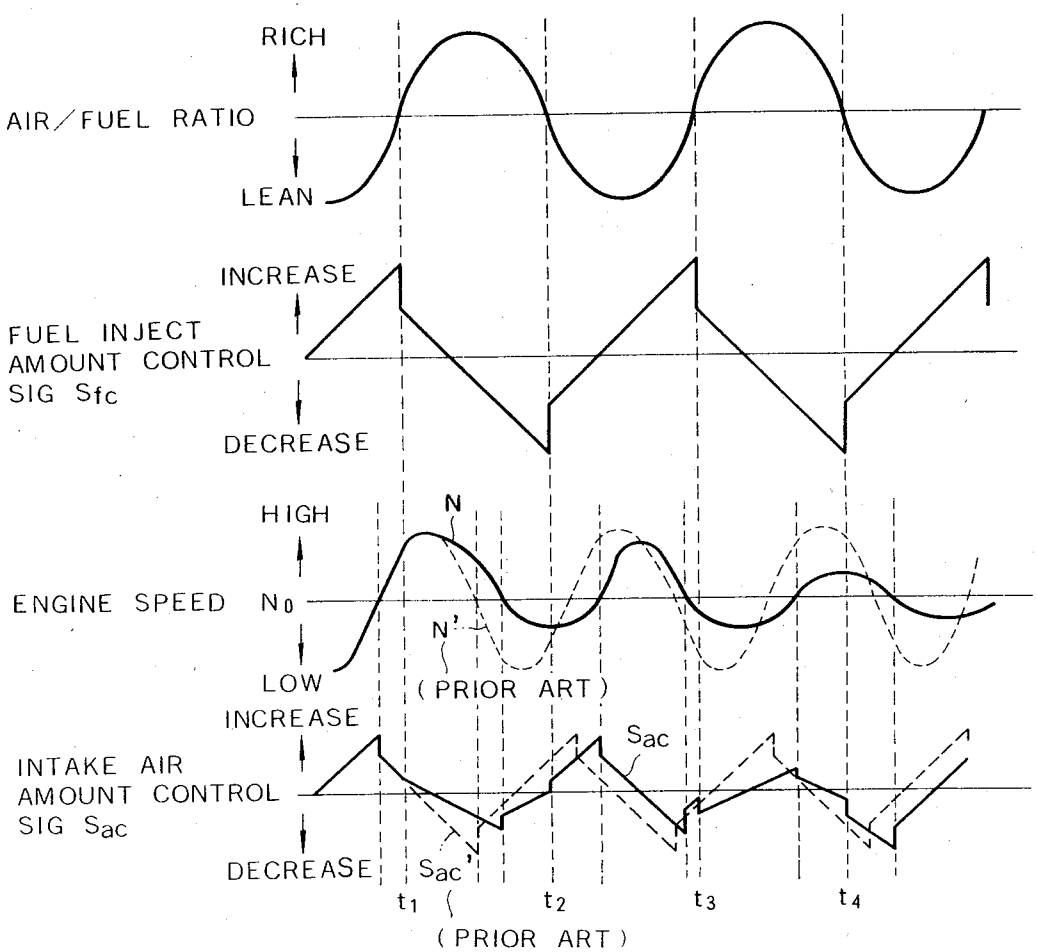
FIG. 3(A) is a graphical representation of an exemplary waveform of an air-to-fuel ratio of the mixture supplied into engine cylinders.
FIG. 3(B) is a graphical representation of the waveform of a fuel injection amount control signal $S_{fc}$ outputted from the calculating section.
FIG. 3(C) is a graphical representation of the waveforms of an engine idling speed N controlled by the system according to the present invention and an engine idling speed N′ controlled by a prior-art system for comparison of both the idling speeds.
FIG. 3(D) is a graphical representation of the waveforms of an intake air amount control signal $S_{ac}$ outputted from the system according to the present invention and an intake air amount control signal $S_{ac}'$ outputted from the prior-art system for comparison of both the signals.

FIG. 3(A) shows the variation in air-to-fuel ratio, in which the ratio is assumed to vary in the form of sine wave.

FIG. 3(B) shows the fuel injection amount control signal $S_{fc}$ for controlling the basic amount of fuel to be injected into the engine cylinders, which is basically determined in response to the air-flow signal $S_a$ detected by the air flow meter 8. This figure indicates that when the fuel is rich, the amount of fuel to be injected is decreased linearly; when the fuel is lean, the amount of fuel to be injected is increased linearly.

FIG. 3(C) shows the variation in engine speed N controlled by the system according to the present invention in the solid curve and the variation in engine speed N′ controlled by a prior-art system in the dashed curve. This figure indicates that engine idling speed N (present invention) fluctuates less than that N′ (prior-art); that is to say, the amplitude of variations in N is smaller than that of N′ and additionally the frequency of the variations in N is smaller than that of N′ (period of N is greater than that of N′).

FIG. 3(D) shows the intake air amount control signal $S_{ac}$ obtained by the system according to the present invention in the solid lines and that $S_{ac}'$ obtained by the prior-art system in the dashed lines. This figure also indicates that the control signal $S_{ac}$ (present invention) fluctuates less than $S_{ac}'$ (prior-art system); that is to say, the amplitude of $S_{ac}$ is smaller than that of $S_{ac}'$ and additionally the frequency of $S_{ac}$ is smaller than that of $S_{ac}'$ (period of $S_{ac}$ is greater than that of $S_{ac}'$).

Further, in FIG. 3(D), since air-to-fuel ratio is rich between points $t_1$ and $t_2$ or between points $t_3$ and $t_4$, the amount of intake air to be by-passed is decreased by decreasing the amplitude of the intake air amount control signal $S_{ac}$ applied to the air flow adjuster 7. In order to decrease the amplitude of the control signal $S_{ac}$, the gain of an amplifier through which the signal $S_{ac}$ is amplified is reduced, or the time constant of an integration circuit through which the signal $S_{ac}$ is passed is increased or the multiplication constant of a multiplier through which the signal $S_{ac}$ is passed is reduced.

Similarly, since the air-to-fuel ratio is lean between points $t_2$ and $t_3$, the amount of intake air to be by-passed is increased by increasing the amplitude of intake air amount control signal $S_{ac}$ applied to the air flow adjuster 7. In order to increase the amplitude of the control signal $S_{ac}$, the gain is increased, or the time constant is decreased or the multiplication constant is increased in the same way as described above.

Further, as depicted in FIG. 3(D), the instant the air-to-fuel ratio becomes lean or rich or the engine idling speed N exceeds or drops below the optimum speed $N_o$, the intake air amount control signal $S_{ac}$ rises or falls abruptly in order to improve the response time, as depicted in the solid lines.

In connection with this, in the prior-art system, only the instant the engine idling speed N' exceeds or drops below the optimum speed $N_o$, the intake air amount control signal $S_{ac}'$ rises or falls abruptly, as depicted in FIG. 3(D) in the dashed lines.

Description has been made hereinabove of the case where the engine speed control system according to the present invention comprises various discrete elements or sections; however, it is of course possible to embody the engine speed control system according to the present invention with a microcomputer including a central processing unit, a read-only memory, a random-access memory, a clock oscillator, etc. In this case, the engine speed calculating section 17, the optimum engine speed calculating section 18, the air-to-fuel ratio determination section 20, the comparator 19, and the intake air amount calculating section 21 can all be incorporated within the microcomputer, executing the same or similar processes, calculations and/or operations as explained hereinabove. That is to say, some of the functions of the present invention are implemented via arithmetic operations executed in accordance with appropriate software, in place of hardware.

Figure 4:
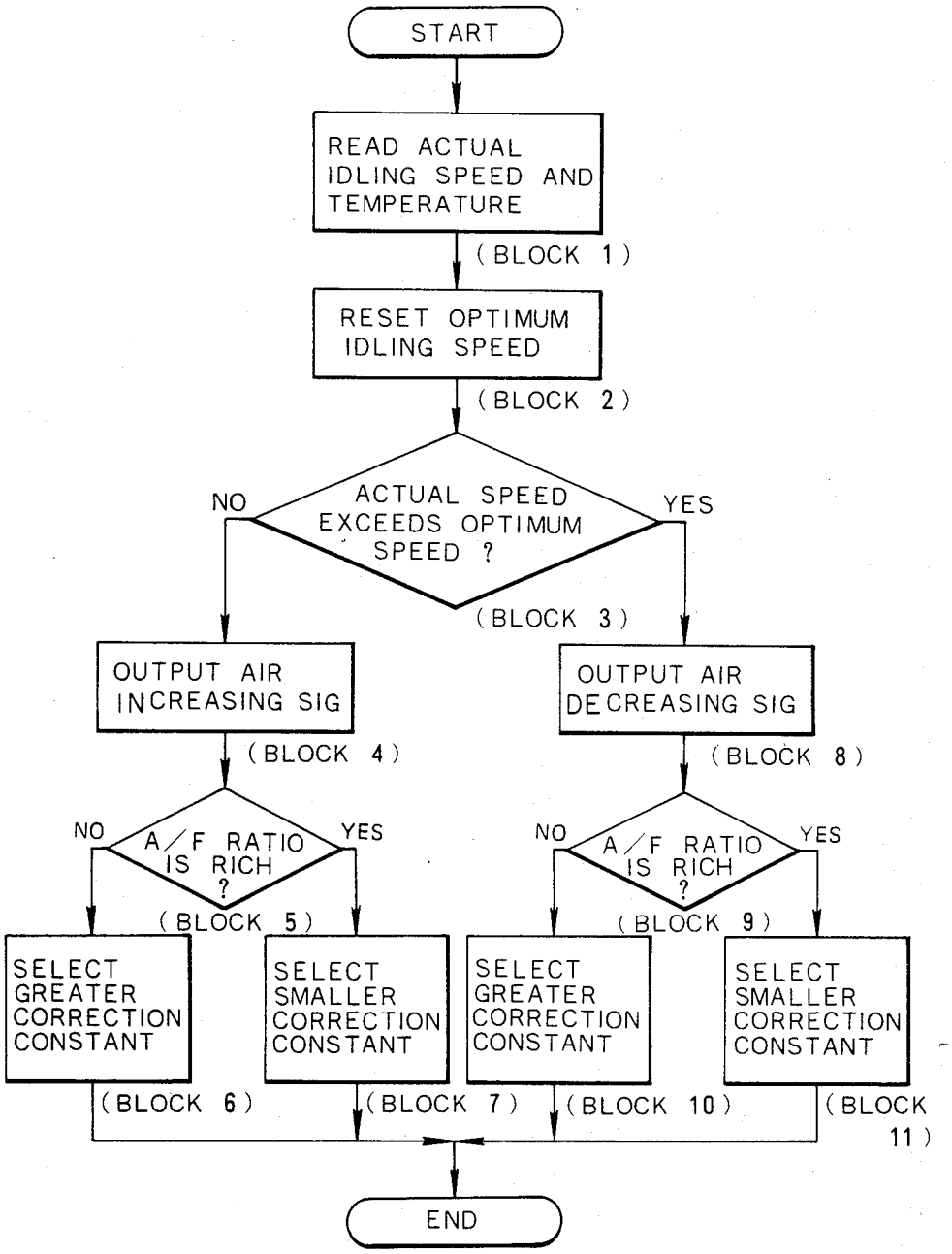
FIG. 4 is a flowchart showing the steps of determining the amount of intake air by-passing the throttle valve on the basis of the engine speed, engine temperature, and air-to-fuel ratio.

FIG. 4 shows a flowchart showing the steps of controlling the engine idling speed in accordance with a program stored in the microcomputer 16 shown in FIG. 1 or 2.

With reference to FIG. 4, when the throttle valve position sensor 5 detects that the engine is being idled, a throttle valve signal $S_t$ indicative of that the throttle valve 4 is fully closed is inputted to the microcomputer 16. In response to this throttle valve signal $S_t$, program control starts sequentially reading the present actual engine idling speed signal $S_s$ outputted from the engine speed sensor 14 such as a crankshaft angle sensor and the present engine coolant temperature signal $S_T$ outputted from the engine temperature sensor 15 and calculates the present engine idling speed N (in block 1). As described already, in this step, it is preferable to sequentially check whether the starter signal is outputted from the starter switch 30 and/or the air-conditioner signal is outputted from the air-conditioner switch 31. On the basis of the temperature signal $S_T$, starter signal and/or air conditioner signal, the program sequentially calculates an optimum engine idling speed $N_o$ and stores it in the memory unit (in block 2).

The calculated present engine idling speed N is compared with the stored present optimum engine idling speed $N_o$ (in block 3). If the actual value N is below the optimum value $N_o$, an intake air amount control signal $S_{ac}$ is generated so as to increase the amount of intake air to be by-passed and supplied into the engine cylinders in proportion to the difference between the two values (in block 4). Next, the computer starts reading the air-to-fuel ratio signal $S_r$ outputted from the oxygen sensor 10 and determines whether the air-to-fuel ratio of the mixture (or fuel) is rich or lean (in block 5).

If lean, a greater correction constant (e.g. greater multiplier or addend) is selected to increase the magnitude of the generated intake air amount control signal $S_{ac}$ for increasing the amount of intake air (in block 6). If rich, a smaller correction constant (e.g. smaller multiplier or addend) is selected to decrease the magnitude of the generated intake air amount control signal $S_{ac}$ for decreasing the amount of intake air (in block 7).

If the actual value N is above the optimum value $N_o$ (in block 3), an intake air amount control signal $S_{ac}$ is generated so as to decrease the amount of intake air to be by-passed and supplied into the engine cylinders in proportion to the difference between the two values (in block 8). Next, the computer starts reading the air-to-fuel ratio signal $S_r$ outputted from the oxygen sensor 10 and determines whether the air-to-fuel ratio of the mixture (or fuel) is rich or lean (in block 9).

If lean, a greater correction constant (e.g. greater multiplier or addend) is selected to increase the magnitude of the generated intake air amount control signal $S_{ac}$ for increasing the amount of intake air (in block 10). If rich, a smaller correction constant (e.g. smaller multiplier or addend) is selected to decrease the magnitude of the generated intake air amount control signal $S_{ac}$ for decreasing the amount of intake air (in block 11).

The calculated and corrected intake air amount control signal $S_{ac}$ is applied to the air flow adjuster 7 to adjust the amount of intake air by-passing throttle valve 4.

Only the case where the amount of intake air 13 is adjusted to control the engine idling speed has been described hereinabove. However, it is also possible to additionally control the amount of fuel to be injected into engine cylinders (the basic amount of the fuel is determined according to the amount of intake air detected by the air flow meter 8), the ignition timing, and/or the amount of recirculation exhaust gas at the same time.

As described above, in the engine idling speed control system for an internal combustion engine according to the present invention, since the engine idling speed is controlled by adjusting the amount of intake air supplied into the engine cylinders by-passing the throttle valve under consideration of air-to-fuel ratio (rich fuel or lean fuel), it is possible to reduce the fluctuations of engine idling speed; that is, to improve the response time in transient state and the stability in steady state.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An idle speed control system for an internal combustion engine having a throttle, a bypass means for providing to said engine intake air bypassing said throttle, an engine speed detector providing an engine speed signal, an optimum engine speed calculating means providing an optimum engine speed signal, and an air-fuel ratio detector providing an air-fuel ratio signal indicating a rich or lean fuel mixture, comprising:

intake air adjusting means including, calculating means for calculating a basic amount of bypass air to be provided to said engine as a function of a difference between said optimum engine speed signal and said engine speed signal, and correcting means for correcting the basic amount of bypass air calculated by said calculating means as a function of said air-fuel ratio signal, and further comprising air flow adjusting means connected to said intake air adjusting means for providing a quantity of air passing through said bypass means corresponding to the corrected basic amount determined by said correcting means.

2. An idle speed control system as recited in claim 1 further comprising an engine temperature detecting means providing an engine temperature signal, and wherein said optimum engine speed calculating means is connected to receive said engine temperature signal and to calculate an optimum engine speed as a function of engine temperature indicated by said engine temperature signal.

3. An idling speed control system for an internal combustion engine provided with an intake pipe, an exhaust manifold and a throttle valve, which comprises:

(a) engine speed sensor means for outputting an engine speed signal;

(b) engine temperature sensor means for outputting an engine temperature signal;

(c) oxygen sensor means disposed within the exhaust passage for outputting an air-fuel ratio signal indicative of rich or lean fuel;

(d) engine speed calculating means responsive to the engine speed signal from said engine speed sensor means for calculating an actual engine speed and outputting an actual engine speed signal corresponding thereto;

(e) optimum engine speed calculating means responsive to the engine temperature signal from said engine temperature sensor means for calculating an optimum engine speed and outputting an optimum engine speed signal corresponding thereto;

(f) comparator means responsive to the actual engine speed signal and the optimum engine speed signal for calculating the difference between the two signals indicative of engine idling speed and outputting an engine speed difference signal corresponding thereto;

(g) air-to-fuel ratio determinating means responsive to said oxygen sensor means for determining whether the air-to-fuel ratio is rich or lean and outputting a rich signal or a lean signal;

(h) intake air calculating means responsive to the engine speed difference signal from said comparator means and the rich signal or lean signal from said air-to-fuel ratio determining means for calculating a basic amount of intake air by-passing the throttle valve on the basis of the engine speed difference signal in such a way that the basic amount of intake air calculated thereby is increased when the actual engine speed is below the optimum engine speed and is decreased when the actual engine speed is above the optimum engine speed and for correcting the calculated basic amount of intake air in such a way that the calculated basic amount of intake air is decreased when fuel is rich and is increased when fuel is lean, said intake air calculating means outputting an intake air amount control signal corresponding to the calculated and corrected amount of intake air; and (i) air flow adjuster means so disposed across the throttle valve as to by-pass the intake air supplied into the engine cylinders and responsive to the intake air amount control signal for adjusting the amount of intake air by-passing the throttle valve, whereby engine idling speed is controlled by adjusting the intake air in accordance with the air-to-fuel ratio.

4. An idling speed control system for an internal combustion engine provided with an intake pipe, an exhaust manifold and a throttle valve, which comprises:

(a) engine speed sensor means for outputting an engine speed signal;

(b) engine temperature sensor means for outputting an engine temperature signal;

(c) oxygen sensor means disposed within the exhaust passage for outputting an air-fuel ratio signal indicative of rich or lean fuel;

(d) a microcomputer means responsive to the engine speed signal, the engine temperature signal, and the air-to-fuel ratio signal for calculating an actual engine speed, an optimum engine speed, and the difference between the actual engine speed and the optimum engine speed, for determining whether the air-to-fuel ratio is rich or lean, for calculating a basic amount of intake air by-passing the throttle valve on the basis of the difference between the actual engine speed and optimum engine speed in such a way that the amount of intake air is increased when the actual engine speed is below the optimum engine speed and is decreased when the actual engine speed is above the optimum engine speed and for correcting the calculated basic amount of intake air in such a way that the basic amount of intake air is decreased when fuel is determined to be rich and is increased when fuel is determined to be lean, said microcomputer outputting an intake air amount control signal corresponding to the calculated and corrected amount of intake air; and (e) air flow adjuster means so disposed across the throttle valve as to by-pass the intake air supplied into the engine cylinders and responsive to the intake air amount control signal for adjusting the amount of intake air by-passing the throttle valve, whereby engine idling speed is controlled by adjusting the intake air in accordance with the air-to-fuel ratio.

5. An idling speed control system for an internal combustion engine as set forth in either claim 3 or 4, which further comprises:

(a) a starter switch for outputting a starter signal indicating that an engine starting motor is in operation, the starter signal being applied to said idling speed control system for correcting the optimum engine speed; and (b) an air-conditioner switch for outputting an air-conditioner signal indicating that an air conditioner is in operation, the air conditioner signal being applied to said idling speed control system for correcting the optimum engine speed.

6. A method of controlling engine idling speed, which comprises the following steps of:

(a) detecting the engine idling speed;

(b) detecting the engine temperature;

(c) calculating the optimum engine idling speed on the basis of the detected engine temperature and storing the calculated optimum engine idling speed;

(d) comparing the detected engine idling speed with the calculated and stored optimum engine idling speed;

(e) if the engine idling speed is below the optimum engine idling speed, increasing an amount of intake air by-passing a throttle valve;

(f) detecting whether the air-to-fuel ratio is rich or lean;

(g) if lean, further correcting the increased amount of intake air to a greater value;

(h) if rich, correcting the increased amount of intake air to a smaller value;

(i) if the engine idling speed is above the optimum engine idling speed, decreasing the amount of intake air by-passing the throttle valve;

(j) detecting whether the air-to-fuel ratio is rich or lean;

(k) if lean, correcting the decreased amount of intake air to a greater value; and (l) if rich, correcting the decreased amount of intake air to a smaller value.

7. A method of controlling engine idling speed as set forth in claim 6, wherein the amount of intake air is increased in step (e) or decreased in step (i) in proportion to the difference between the engine idling speed and the optimum engine idling speed.

8. A method of controlling engine idling speed as set for in claim 6, wherein the amount of intake air is increased in step (e) or decreased in step (i) in proportion to the integrated value of the difference between the engine idling speed and the optimum engine idling speed.

9. A method of controlling engine idling speed as set forth in claim 6, wherein the amount of intake air is increased in step (e) or decreased in step (i) in proportion to the addition of the difference between the engine idling speed and the optimum engine idling speed and the integrated value of the difference between the engine idling speed and the optimum engine idling speed.

10. A method of controlling engine idling speed as set forth in claim 6, wherein the calculated amount of intake air is corrected to a greater value in steps (g) and (k) by multiplying the calculated amount by a predetermined positive multiplier greater than one.

11. A method of controlling engine idling speed as set forth in claim 6, wherein the calculated amount of intake air is corrected to a smaller value in steps (h) and (l) by multiplying the calculated amount by a predetermined positive multiplier smaller than one.

12. A method of controlling engine idling speed as set forth in claim 6, wherein the calculated amount of intake air is corrected to a greater value in steps (g) and (k) by adding a predetermined positive addend to the calculated amount.

13. A method of controlling engine idling speed as set forth in claim 6, wherein the calculated amount of intake air is corrected to a smaller value in steps (h) and (l) by adding a predetermined negative addened to the calculated amount.

* * * * *